US005382106A

United States Patent [19]

Voigt

[11] Patent Number: 5,382,106

[45] Date of Patent: Jan. 17, 1995

[54] TOOTHBRUSH WITH A TEETH CLEANSING SUBSTANCE DISPENSING SYSTEM

[76] Inventor: Bernard Voigt, 15 High St., Hicksville, N.Y. 11801

[21] Appl. No.: 61,036

[22] Filed: May 13, 1993

[51] Int. Cl.[6] ..... A45D 40/00; A46B 11/02; B65D 35/34

[52] U.S. Cl. ..... 401/155; 222/100; 401/280; 401/157; 401/169; 401/164; 401/175; 401/190

[58] Field of Search ..... 401/164, 163, 161, 158, 401/156, 155, 145, 153, 271, 278, 280, 287; 222/98-101

[56] References Cited

U.S. PATENT DOCUMENTS

| | | | |
|---|---|---|---|
| 1,615,999 | 2/1927 | Perelman | 401/155 |
| 2,162,447 | 6/1939 | Seibel | 401/155 X |
| 2,557,267 | 6/1951 | Ellinger | 401/280 X |
| 2,742,189 | 4/1956 | Morrison | 222/100 |
| 3,917,118 | 11/1975 | Odgen | 222/100 |

FOREIGN PATENT DOCUMENTS

| | | | |
|---|---|---|---|
| 2438443 | 6/1980 | France | 401/280 |

*Primary Examiner*—Danton D. DeMille
*Attorney, Agent, or Firm*—Michael I. Kroll

[57] ABSTRACT

An improved toothbrush with a teeth cleansing substance dispensing system is provided, which consists of a mechanism in cooperation with a compartment in an enlarged handle, which will dispense some teeth cleansing substance through a channel in a neck and head and out through at least one lateral passageway into bristle groups, so that the bristle groups can clean teeth. An apparatus is also in cooperation with the channel in the head and neck for sealing the at least one lateral passageway, when not in use. This stops the flow of the teeth cleansing substance and prevents germs, bacteria, water and other foreign elements from contaminating the teeth cleansing substance left in the channel and the compartment.

2 Claims, 4 Drawing Sheets

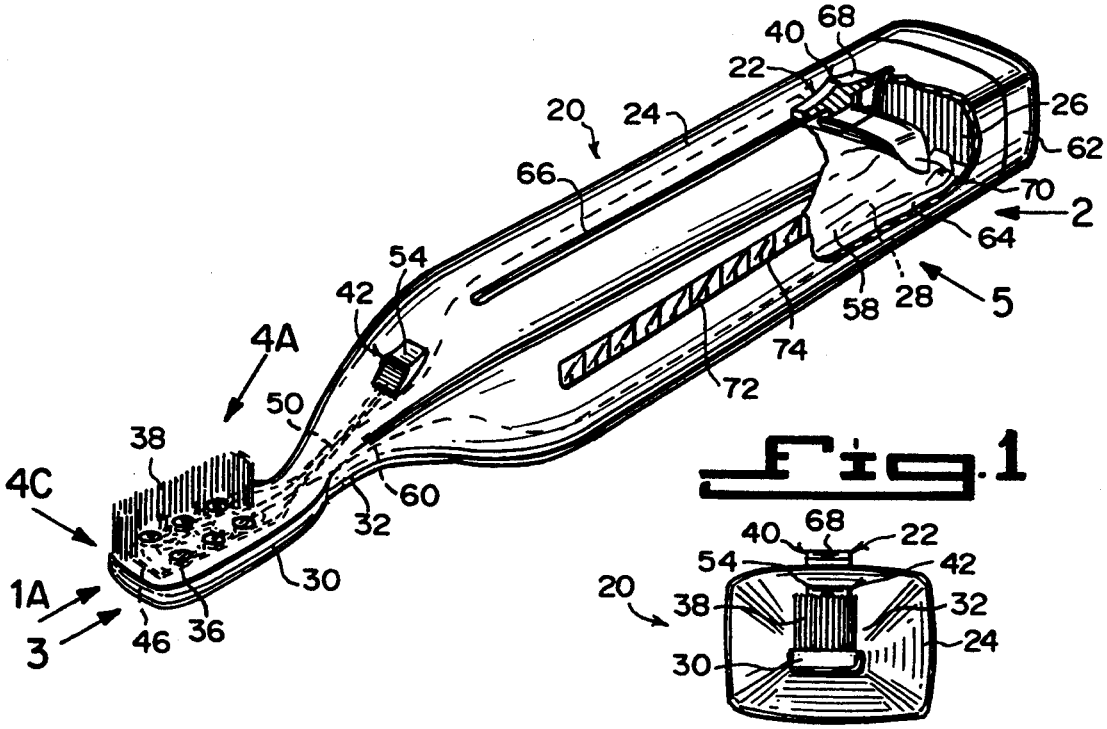
Fig. 1
Fig. 1A
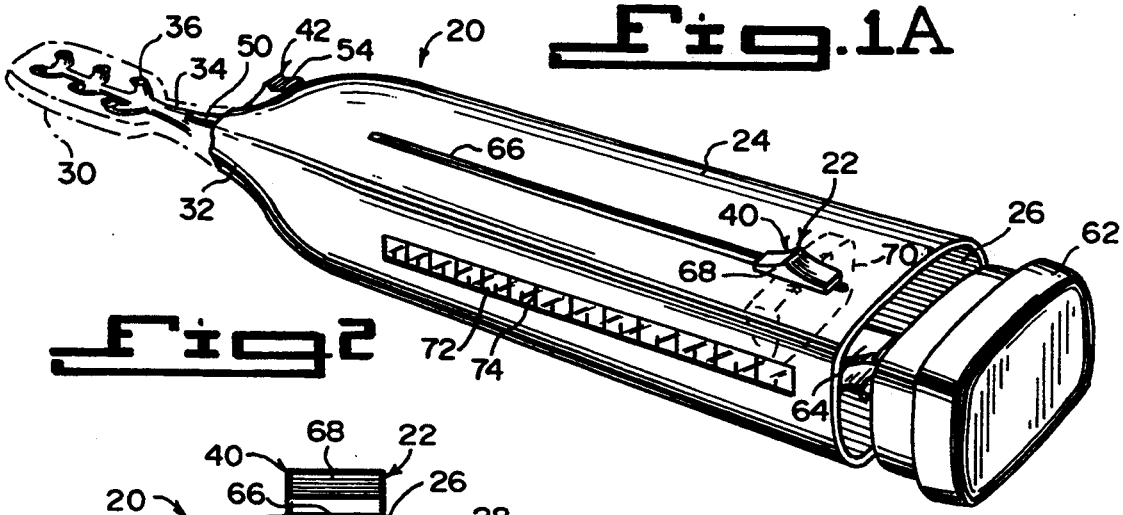
Fig 2
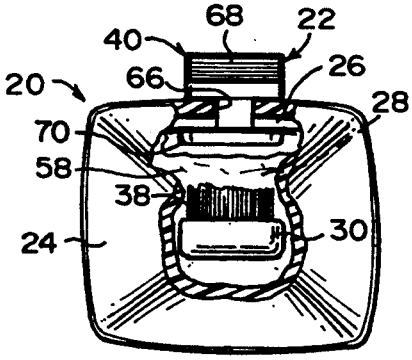
Fig. 3

TOOTHBRUSH WITH A TEETH CLEANSING SUBSTANCE DISPENSING SYSTEM

BACKGROUND OF THE INVENTION

Field of the Invention

The instant invention relates generally to dental care equipment and more specifically it relates to an improved toothbrush with a teeth cleansing substance dispensing system.

Description of the Prior Art

Numerous dental care devices have been provided in prior art that are adapted to clean the teeth of people, such as toothbrushes, dental floss and water picks. While these units may be suitable for the particular purpose to which they address, they would not be as suitable for the purposes of the present invention as heretofore described.

SUMMARY OF THE INVENTION

A primary object of the present invention is to provide an improved toothbrush with a teeth cleansing substance dispensing system that will overcome the shortcomings of the prior art devices.

Another object is to provide an improved toothbrush with a teeth cleansing substance dispensing system in which the dispensing system that is built into a compartment in the handle can bring the teeth cleansing substance directly into the bristle groups in the head and then upward through small holes located in the spaces separating the bristle groups, at the base of the head.

An additional object is to provide an improved toothbrush with a teeth cleansing substance dispensing system that includes a mechanism which will seal the passageway when not in use, so as to stop the flow of the teeth cleansing substance and also to prevent germs, bacteria, water, etc. from contaminating the teeth cleansing substance left in the head, neck and the compartment within the handle.

A further object is to provide an improved toothbrush with a teeth cleansing substance dispensing system that is simple and easy to use.

A still further object is to provide an improved toothbrush with a teeth cleansing substance dispensing system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view with parts broken away and in section of a first embodiment of the instant invention.

FIG. 1A is an end view taken in direction of arrow 1A in FIG. 1.

FIG. 2 is a perspective view with parts removed taken in direction of arrow 2 in FIG. 1.

FIG. 3 is an end view with parts broken away and in section taken in direction of arrow 3 in FIG. 1.

DETAILED DESCRIPTION OF THE PREFERRED EMBODIMENTS

Figure 4A:
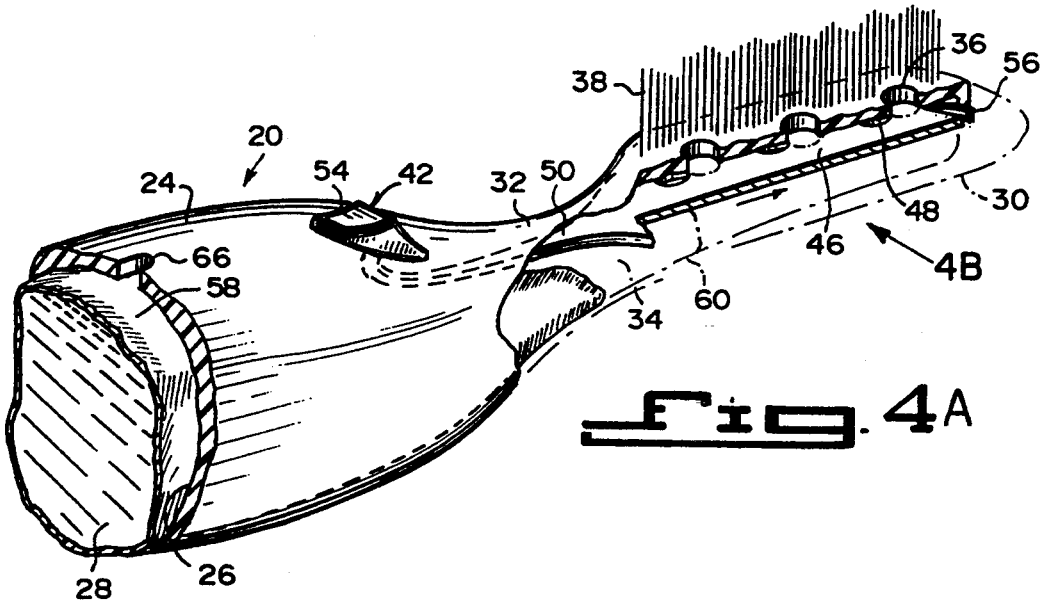
FIG. 4A is an enlarged perspective view with parts removed, broken away and in section taken in direction of arrow 4A in FIG. 1.

Turning now descriptively to the drawings, in which similar reference characters denote similar elements throughout the several views, FIGS. 1 through 17 illustrate an improved toothbrush 20 with a teeth cleansing substance dispensing system 22 which consists of an enlarged handle 24 having a compartment 26 for storing a teeth cleansing substance 28 therein. A head 30 and neck 32 are attached to one end of the enlarged handle 24. The head 30 and the neck 32 have a channel 34 therethrough connected to the compartment 26 within the enlarged handle 24. At least one lateral passageway 36 extends inwardly from a top surface of the head 30 terminating with the channel 34. A plurality of bristle groups 38 extend outwardly from the top surface of the head 30. A mechanism 40 is in cooperation with the compartment 26 in the enlarged handle 24 for dispensing some of the teeth cleansing substance 28 through the channel 34 and the at least one lateral passage way 36 into the bristle groups 38, so that the bristle groups 38 can clean teeth.

An apparatus 42 in cooperation with the channel 34 in the head 30 and the neck 32 is for sealing the at least one lateral passageway 36 when not in use. This stops the flow of the teeth cleansing substance 28 and prevents germs, bacteria, water and other foreign elements from contaminating the teeth cleansing substance 28 left in the channel 34 and the compartment 26.

Figure 4B:
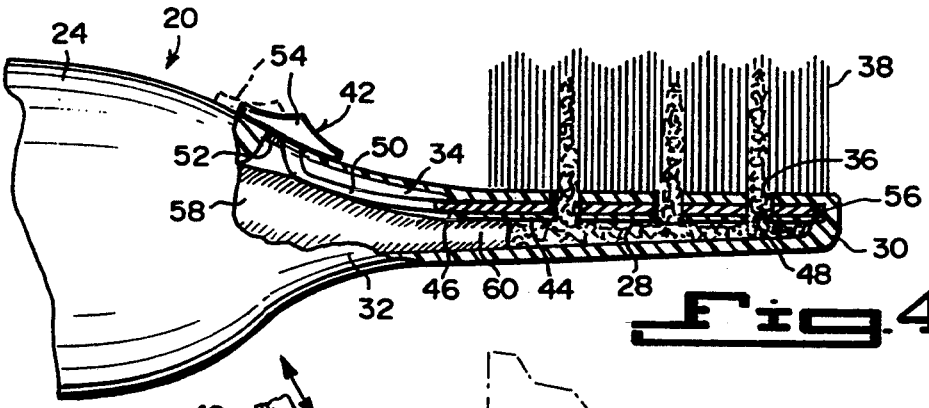
FIG. 4B is a side view taken with parts broken away and in section taken in direction of arrow 4B in FIG. 4A.
Figure 4C:
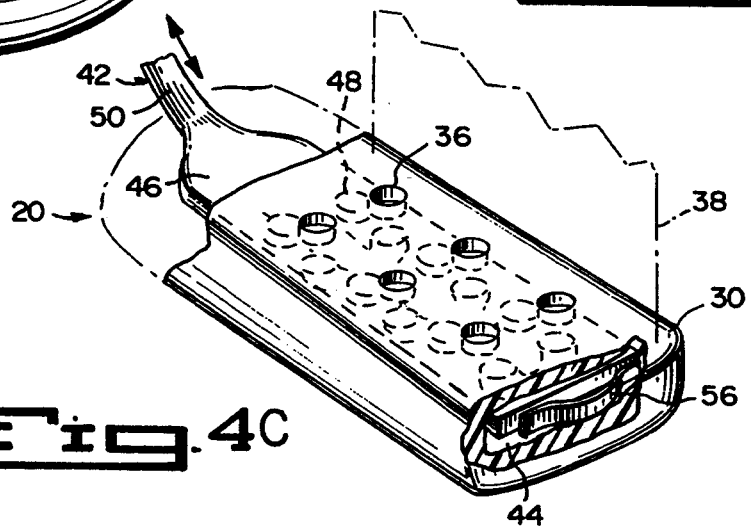
FIG. 4C is a perspective view with parts broken away, in section and in phantom taken in direction of arrow 4C in FIG. 1.
Figure 6:
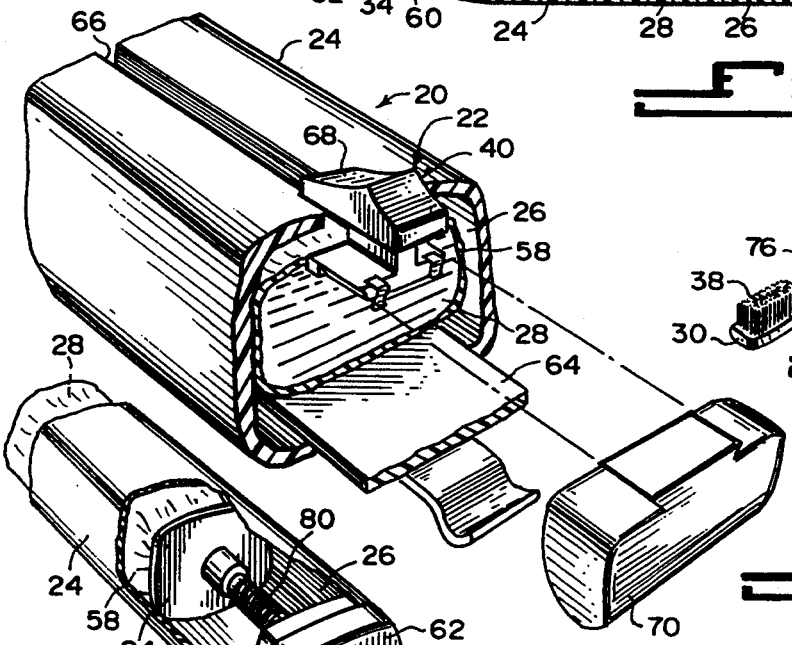
FIG. 6 is a cross sectional perspective view taken generally along line 6—6 in FIG. 5, with the push plate exploded therefrom.

The sealing apparatus 42, as best seen in FIGS. 4A to 4C, contains a track 44 built into the head 30 directly below the at least one lateral passageway 36. A slide plate 46 has at least one aperture 48 therethrough and a tongue 50 extends from a rearward end thereof. The slide plate 46 fits into and moves within the track 44. The neck 32 has a slot 52 in a top surface, so that a distal end of the tongue 50 can extend into the slot 52. A slide button 54 is connected to the distal end of the tongue 50 above the slot 52. When the slide button 54 is moved the slide plate 46 will move in the track 44, allowing the at least one aperture 48 in the slide plate 46 to align with the at least one passageway 36, so as to let some of the teeth cleansing substance 28 pass between the bristle groups 38.

The sealing apparatus 42 further includes a spring 56 mounted on a forward end of the slide plate 46, so as to return the slide plate 46 back to its original unaligned position when the slide button 54 is released, thereby sealing the at least one passageway 36. A flexible elongate enclosure 58 having a spout 60, is for retaining the teeth cleansing substance 28 therein. The enclosure 58 fits into the compartment 26 within the enlarged handle 24, while the spout 60 extends into the channel 34 in the neck 32. A removable end cap 62 fits into an open second end of the enlarged handle 24, so as to gain access into the compartment 26 to insert and remove the flexible elongate enclosure 58 with the teeth cleansing substance 28.

The dispensing mechanism 40, as best seen in FIGS. 1, 2, 5 and 6, contains a spring platform 64 placed into a bottom surface of the compartment 26, so as to bias the flexible elongate enclosure 58 upwardly within the compartment 26. The enlarged handle 24 has a longitudinal central slot track 66 in a top surface. A dispenser button 68 rides within the slot track. A push plate 70 is connected to the dispenser button 68 within the compartment 26. When the dispenser button 68 is moved within said slot track 66 towards the head 30, the push plate 70 will compress the flexible elongate enclosure 58, to force some of the teeth cleansing substance 28 through the spout 60 and into the channel 34 in the neck 32.

An elongate transparent indicator window 72 with a scale 74 thereon is located within one side of the enlarged handle 24. This allows a person to look into the compartment 26 and see how much of the teeth cleansing substance 28 has been used within the flexible elongate enclosure 58.

Figure 5:
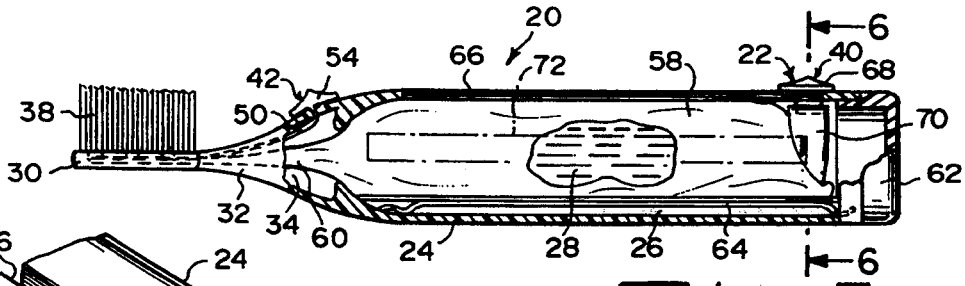
FIG. 5 is a side view with parts broken away and in section taken in direction of arrow 5 in FIG. 1.
Figure 5A:
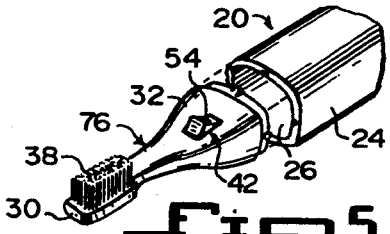
FIG. 5A is a perspective view showing a detachable bristle head assembly separated from the handle.

FIG. 5A shows a detachable bristle head assembly 76 between the enlarged handle 24 and the neck 32, so that the detachable bristle head assembly 76 can be removed from and replaced to said enlarged handle 24 when needed.

Figure 7:
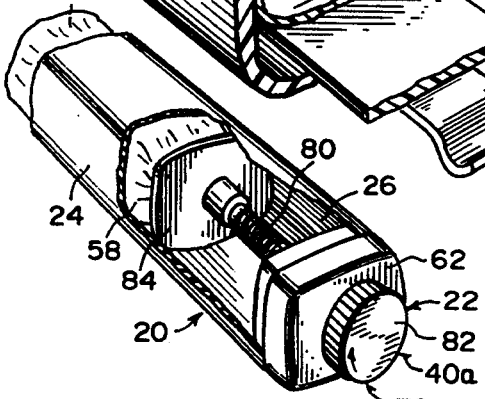
FIG. 7 is a perspective view of a second embodiment with parts removed broken away and in section.

FIG. 7 shows a second type of dispensing mechanism 40*a*. The removable end cap 62 has a central threaded bore therethrough. A turn screw 78 has a threaded shank 80 and an enlarged knob 82. The threaded shank 80 enters the central threaded bore in the end cap 62, when the enlarged knob 82 is manually turned. A push plate 84 is connected to a distal end of the threaded shank 80 within the compartment 26. When the enlarged knob 82 is manually turned the threaded shank 80 will drive the push plate 84 towards the head 30, to compress the flexible elongate enclosure 58 to force some of the teeth cleansing substance 28 through the spout 68 and into the channel 34 in the neck 32.

Figure 8:
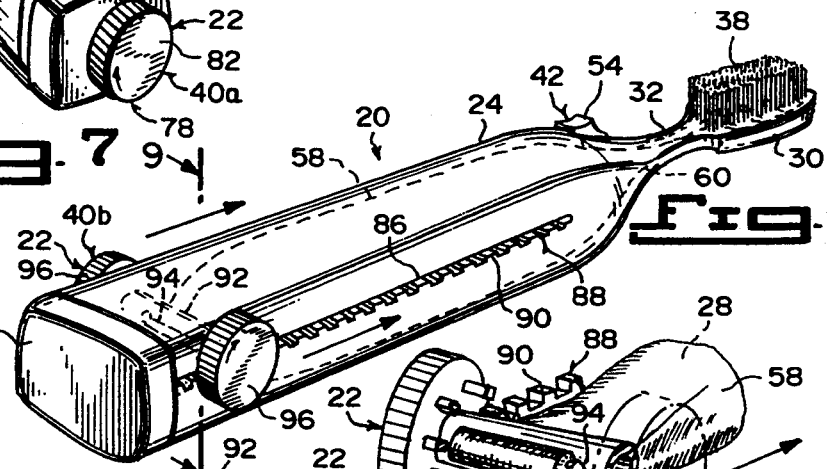
FIG. 8 is a perspective view of a third embodiment.
Figure 9:
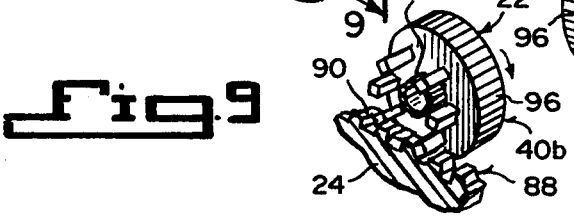
FIG. 9 is a cross sectional perspective view taken along line 9—9 in FIG. 8.
Figure 9A:
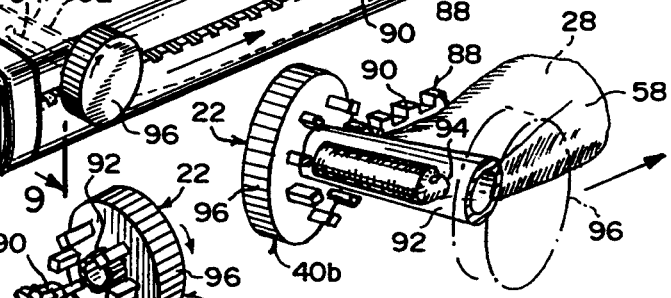
FIG. 9A is a perspective view of a portion of the internal structure within the handle of FIG. 8.

FIGS. 8, 9 and 9A show a third type of dispensing mechanism 40*b*. The enlarged handle 24 has a pair of elongate parallel longitudinal central slots 86 in opposite sides therealong. A pair of racks 88 are provided, with each having a plurality of teeth 90 formed along a lower edge of each side slot 86. A shaft 92 has an elongate aperture 94 therethrough. The shaft 92 can extend transversely across the side slots 86 with a back end of the flexible elongate enclosure 58 extending through the elongate aperture 94 to wrap about the shaft 92. A pair of pinwheels 96 are also provided, with each affixed to an opposite end of the shaft 92 externally of the enlarged handle 24, to engage with one of the racks 88. When the pinwheels 96 are manually turned they will ride upon the racks 88, to roll up the flexible elongate enclosure 58 about the shaft 92, to force some of the teeth cleansing substance 28 through the spout 60 and into the channel 34 in the neck 32.

Figure 10:
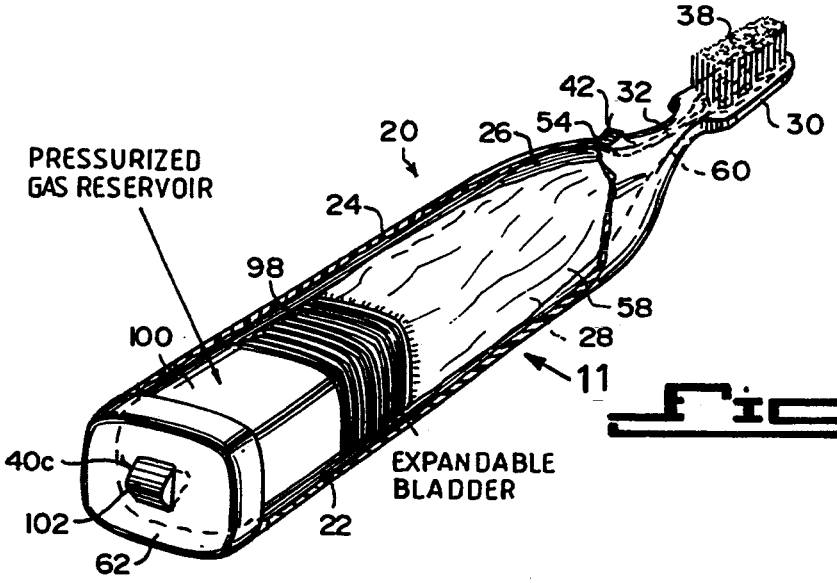
FIG. 10 is a perspective view of a third embodiment with parts broken away and in section.
Figure 11:
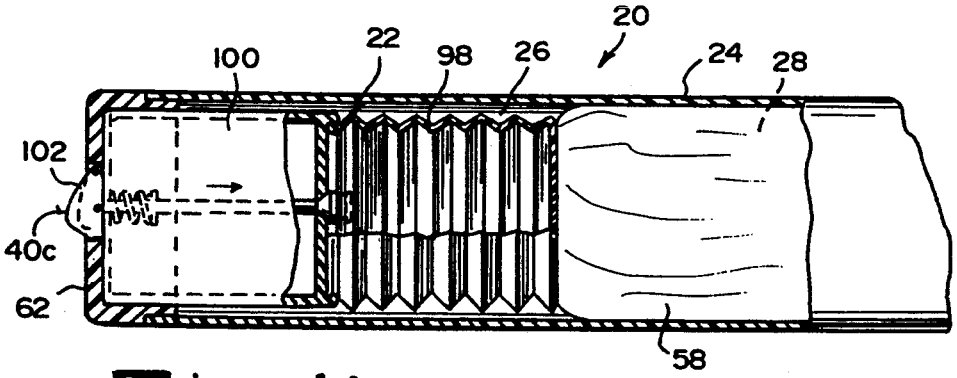
FIG. 11 is a side view with parts broken away and in section, of a portion of the third embodiment as indicated by arrow 11 in FIG. 10.

FIGS. 10 and 11 show a fourth type of cleansing dispensing mechanism 40*c*. An expandable bladder 98 is placed into the compartment 26 of the enlarged handle 24 behind the flexible elongate enclosure 58. A pressurized gas reservoir 100 is placed into the compartment 26 of the enlarged handle 24, between the expandable bladder 28 and the removable end cap 62. A switch 102 on the pressurized gas reservoir 100 extends through the removable end cap 62. When the switch 102 is activated the pressurized gas reservoir 100 will fill the expandable bladder 98, to compress the flexible elongate enclosure 58 and force some of the teeth cleansing substance 28 through the spout 60 and into the channel 34 in the neck 32.

Figure 12:
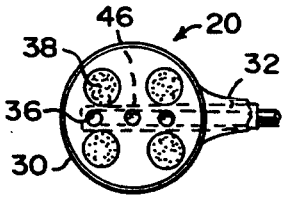
FIGS. 12 through 17 are top views of various bristle head configurations.
Figure 13:
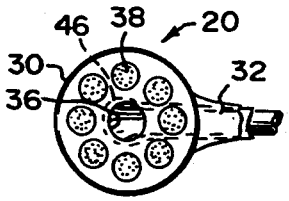
Figure 14:
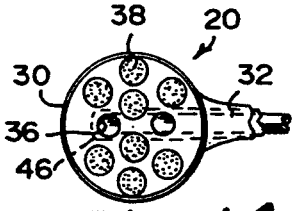
Figure 15:
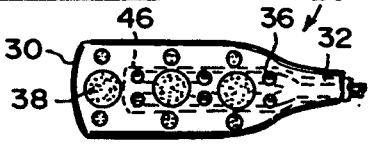
Figure 16:
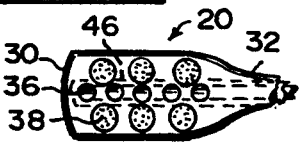
Figure 17:
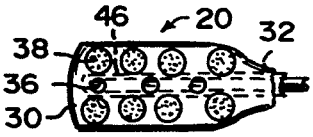

The teeth cleansing substance 28 can include one of the following: toothpaste, gel or foam. The head 30 can be circular as shown in FIGS. 12 through 14 or rectangular as shown in FIGS. 15 through 17. Three passageways 36 are shown in FIG. 12, one passageway 36 in FIG. 13 and two passageways 36 in FIG. 14. Six passageways 36 are shown in FIG. 15, five passageways 36 in FIG. 16 and three passageways 36 in FIG. 17. Other types of head configurations and passageway combinations not illustrated, can also be incorporated into the invention.

LIST OF REFERENCE NUMBERS 20 improved toothbrush
22 teeth cleansing substance dispensing system
24 enlarged handle of 20
26 compartment in 24
28 teeth cleansing substance
30 head of 20
32 neck of 20
34 channel in 30 and 32
36 lateral passageway
38 bristle group
40 first type of dispensing mechanism
40*a* second type of dispensing mechanism
40*b* third type of dispensing mechanism
40*c* fourth type of dispensing mechanism
42 sealing apparatus
44 track in 30
46 slide plate
48 aperture in 46
50 tongue on 46
52 slot in 32
54 slide button
56 spring on 46
58 flexible elongate enclosure
60 spout on 58
62 removable end cap
64 spring platform
66 longitudinal central slot track
68 dispenser button
70 push plate on 68
72 elongate transparent indicator window
74 scale on 72
76 detachable bristle head assembly 78 turn screw
80 threaded shank of 78
82 enlarged knob of 78
84 push plate on 80
86 elongate parallel longitudinal central side slot in 24
88 rack in 86
90 teeth on 88
92 shaft
94 elongate aperture in 92
96 pinwheel
98 expandable bladder
100 pressurized gas reservoir
102 switch on 100

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An improved toothbrush with a teeth cleansing substance dispensing system which comprises:

an enlarged handle having a hollow compartment therein;

a head and neck attached to a first end of said enlarged handle, said head and said neck having a channel therethrough connected to said hollow compartment;

a flexible elongate enclosure tube for retaining the teeth cleansing substance therein, said tube being fit into said hollow compartment and having a spout extending into said channel in said neck so as to permit flow of the teeth cleansing substance from said tube through said spout into said channel in said neck and head;

a plurality of bristle groups extending outwardly from a surface of said head;

lateral passageways in said head extending from said bristle groups into said channel in said head;

dispensing means, cooperating with the compartment in said enlarged handle, for dispensing some of the teeth cleansing substance through said channel and said lateral passageways into said bristle groups so that said bristle groups can clean teeth, said dispensing means comprising;

a pair of elongated side slots on opposite sides of said handle said slots being parallel and extending along a longitudinal direction of said handle;

a plurality of teeth formed along a lower edge of each said side slot and extending toward an upper edge of each said slot so as to form a pair of racks;

a shaft extending transversely across said hollow compartment in said handle between and through said side slots, said shaft having an elongated aperture for inserting an end of said tube therethrough so as to be able to wrap said tube about said shaft; and pinwheels affixed to opposite ends of said shaft externally of said enlarged handle wherein each pinwheel includes;

a planar inner surface parallel with a side of said handle in which said side slots are formed:

a circular group of tooth like appendages projecting normally inwardly from said planar inner surface into a respective said side slot to engage said teeth in one of said racks; and a cylindrical outer surface suitable for manually gripping and turning said pinwheel and said shaft; and sealing means for sealing said lateral passageways when not in use, said sealing means comprising;

a track built into said head directly below said lateral passageways and extending into said neck;

a slide plate for moving in said track, said slide plate having apertures at positions corresponding to the positions of said lateral passageways in said head, and a tongue extending into said neck from an opposite end thereof;

spring means mounted on a forward end of said slide plate for biasing said plate to a closed position where said apertures are not aligned with said lateral passageways;

a slot in a top surface of said neck overlying a distal end of said tongue opposite said forward end of said slide plate; and a slide button above said slot connected to said distal end of said tongue; wherein when said pinwheels are manually turned, said tooth like appendages engage said teeth in said side racks to wrap said tube about said shaft and force some of the teeth cleansing substance from said tube, through said spout, and into said channel in said neck; and wherein when said slide button is manually moved, said slide plate will move in said track, against the bias of said spring means, to a position aligning said apertures in said slide plate with said lateral passageways in said head so as to allow the teeth cleansing substance pass into said bristle groups, and when said slide button is released, the biased spring means returns said slide plate to said closed position to stop any flow of the teeth cleansing substance and prevent foreign elements from contaminating the teeth cleansing substance remaining in said channel and said tube.

2. An improved toothbrush with a teeth cleansing substance dispensing system as recited in claim 1, further comprising:

a removable cap which fits into a second end of said enlarged handle so as to allow access to said hollow compartment to insert and remove said tube containing the teeth cleansing substance.

* * * * *